US006394364B1

(12) United States Patent
Abplanalp

(10) Patent No.: US 6,394,364 B1
(45) Date of Patent: May 28, 2002

(54) AEROSOL SPRAY DISPENSER

(76) Inventor: Robert Henry Abplanalp, Ten Hewitt Ave., Bronxville, NY (US) 10708

( * ) Notice: Subject to any disclaimer, the term of this patent is extended or adjusted under 35 U.S.C. 154(b) by 2 days.

(21) Appl. No.: 09/675,933

(22) Filed: Sep. 29, 2000

(51) Int. Cl.[7] ..... B05B 7/30
(52) U.S. Cl. ..... 239/354; 239/340; 222/145.1
(58) Field of Search ..... 239/333, 337, 239/340, 353, 354, 303, 304, 306; 222/402.18, 399, 635, 145.1

(56) References Cited

U.S. PATENT DOCUMENTS

| | | | | |
|---|---|---|---|---|
| 3,289,949 A | | 12/1966 | Roth | |
| 3,388,838 A | | 6/1968 | Marchant | |
| 3,389,837 A | | 6/1968 | Marand | |
| 3,401,844 A | | 9/1968 | Hanson, Jr. | |
| 3,409,180 A | * | 11/1968 | Schenk | 239/337 X |
| 3,420,415 A | | 1/1969 | Kuffer | |
| 3,451,596 A | | 6/1969 | Marand | |
| 3,730,437 A | * | 5/1973 | Rousselot | |
| 3,894,659 A | | 7/1975 | Focht | |
| 4,015,752 A | | 4/1977 | Meuresch et al. | |
| 4,015,757 A | | 4/1977 | Meuresch et al. | |
| 4,203,552 A | * | 5/1980 | Hayes | 239/337 |
| 4,396,152 A | | 8/1983 | Abplanalp | |
| 4,431,119 A | * | 2/1984 | Stoody | |
| 4,441,632 A | | 4/1984 | Stoody | |
| 5,507,420 A | | 4/1996 | O'Neill | |
| 6,036,111 A | | 3/2000 | Abplanalp | |
| 6,062,493 A | | 5/2000 | Abplanalp | |
| 6,092,697 A | | 7/2000 | Weaver et al. | |

* cited by examiner

*Primary Examiner*—Lesley D. Morris
(74) *Attorney, Agent, or Firm*—Kilgannon & Steidl

(57) ABSTRACT

A dual receptacle aerosol sprayer with a thin, flexible plastic outer receptacle for product and a substantially rigid inner receptacle for propellant seated within the outer receptacle. A closure closes the inner receptacle and contains a valve assembly. Primary propellant and secondary product valves in the valve assembly control flow from the inner and outer receptacles up propellant and product valve stem bores into an actuator having an aspirating nozzle insert with a Venturi constriction. A conduit extends from the valve assembly through the inner receptacle and into the outer receptacle. To avoid propellant overloading and rupture of the outer receptacle, a one-way tertiary valve downstream of the secondary product valve closes on clogging of the actuator discharge outlet to prevent, during actuation, misdirected propellant flow from the actuator and through the stem product bore and the secondary product valve, from entering the outer product-containing receptacle. The valve assembly has a side wall propellant passage positioned between the primary and secondary valves. Propellant pressure filling paths are provided through the valve assembly which exclude filling propellant from passing into product flow paths.

19 Claims, 6 Drawing Sheets

AEROSOL SPRAY DISPENSER

FIELD OF THE INVENTION

The present invention relates to hand held sprayers for spraying various aerosol products, more particularly to dual receptacle sprayers having a first receptacle for containing the product to be dispensed and a second receptacle for containing a pressurized propellant to dispense the product.

BACKGROUND OF THE INVENTION

Dual receptacle sprayers of various types are well known, including sprayers having side by side receptacles, sprayers having piggyback receptacles wherein a propellant receptacle is positioned on top of a product receptacle, and sprayers wherein a propellant receptacle is positioned within a product receptacle to form inner and outer receptacles. A particular advantage of such dual receptacle sprayers is that they lend themselves to the use of less propellant and higher product to propellant ratios at the discharge outlet, very desirable features in view of the expense and environmental concerns relating to commonly used aerosol propellants such as those containing volatile organic compounds. In dual receptacle sprayers of the piggyback or inner-outer type, an aerosol valve is mounted at the top of the propellant receptacle and contains a valve stem through which both product and propellant can pass into an actuator mounted on the top of the valve stem. A conduit for the product is positioned below the valve and passes in sealed fashion through the inside and out of the bottom of the propellant receptacle down into the product receptacle. A Venturi constriction is present in the actuator, and when the aerosol valve is actuated, the flow of propellant from the propellant receptacle through the valve and through the Venturi constriction draws product from the product receptacle through the conduit and valve into the actuator to mix with the propellant and be dispensed from the actuator.

For a satisfactory dual receptacle sprayer having inner propellant and outer product receptacles, there are a large number of criteria that need to be addressed and satisfied. First of all, the sprayer needs to be safe from rupture of the propellant receptacle causing injury to the user. Second, the sprayer needs to be safe from propellant inadvertently entering the product receptacle upon actuator clogging or due to poorly designed propellant receptacle placement, to cause rupture of the product receptacle and injury to the user. Third, propellant should not in any event inadvertently enter the product receptacle upon actuator clogging or because of poorly designed propellant chamber and valve placement, since the inadvertent adding of propellant to the product will change the predetermined product to propellant ratio to be dispensed when the sprayer is later actuated (for example, after the clogged actuator is cleaned). Fourth, the sprayer packaging should be economical to manufacture and aesthetically pleasing in appearance to the user, both in shape, feel and graphics of the overall package. Fifth, the product in the product receptacle should not be open to the atmosphere so that when the sprayer is not in use, the product in the product receptacle cannot evaporate, be contaminated, or be released from the sprayer by dropping the sprayer or squeezing the outer product receptacle. Sixth, the design of Venturi constriction in the actuator should provide high product to propellant ratios for the aforementioned reasons. Seventh, the product receptacle advantageously may be refillable, and the propellant receptacle and valve can be replaceable for interchangeability and reuse in dispensing various products. The closure of the propellant receptacle and its seating within the product receptacle should be simple to manufacture and designed to prevent any blow-off of the closure by the propellant. Eighth, the propellant receptacle and valve structure advantageously may be designed to permit high speed pressure filling of the propellant receptacle through valve structure which must also be adapted for product flow during spraying, while excluding propellant flow from entering the product flow path of the valve structure during said pressure filling. Pressure filing of volatile organic propellant components is advantageous vis-a-vis under the mounting cup filling for environmental and economic reasons, as is well known, and smaller amounts of expensive propellant can be used. Ninth, the valving structure for both product and propellant flow through the housing and stem of the valve should be simple in construction and manufacture. Tenth, means should be provided to maintain atmospheric pressure in the product receptacle as product is sprayed, so that as the product is drawn out of the product receptacle the product receptacle will not distort or collapse inwardly because of lowered internal pressure. At least these criteria are relevant to a commercially satisfactory, economical and safe sprayer having inner and outer receptacles.

The prior art to date has at best only partially satisfied the above criteria for sprayers with inner and outer receptacles. In certain of the prior art, the propellant receptacle is the outer receptacle so that rupture immediately exposes the user to injury. Other prior art places the propellant chamber inside the propellant chamber, but provides no means to prevent propellant, upon clogging of the actuator nozzle or unsatisfactory valve-propellant receptacle placement, from finding a path into the product chamber to potentially cause rupture or as a minimum change the ultimate product to propellant ratios dispensed. Certain other such prior art variously provides complicated and/or inadequate means to suspend the propellant receptacle within the product receptacle, which means can be blown off the top of the propellant receptacle and which allow seepage from the propellant receptacle into the product receptacle through a valve sealing gasket; complicated designs for the propellant and product valves; no valve shut-off of the product container when the sprayer is not being used; inadequate Venturi constructions; and/or no means to pressure fill the propellant receptacle.

Representative of the above prior art are U.S. Pat. Nos. 3,289,949; 3,388,838; 3,389,837; 3,401,844; 3,451,596; 3,894,659; 4,441,632; 5,507,420; and 6,092,697.

SUMMARY OF THE INVENTION

The present invention provides a dual receptacle aerosol spray dispenser having a thin, flexible plastic outer receptacle adapted to contain the product to be dispensed. An inner, substantially rigid, receptacle is seated within the outer receptacle and is adapted to contain a pressurized propellant out of contact with the product to be dispensed. A closure in the form of an aerosol valve mounting cup or the like sealingly closes the top of the inner receptacle. Centrally positioned on the closure is an aerosol valve assembly having an aerosol valve housing, a valve stem extending out of the closure, and a primary valve for controlling flow from the propellant receptacle. A product conduit from the lower end of the valve housing extends through the inner propellant receptacle into the outer product receptacle. The aerosol valve assembly also includes a secondary shut-off valve for controlling flow from the product receptacle, whereby product flow cannot occur through the secondary valve and out of the sprayer when the sprayer is not in use, and contamination or evaporation of the product in the product receptacle accordingly will not occur. The valve stem includes upwardly extending bores open at their upper ends, one of said bores being in fluid communication with the primary valve and another of said bores being a central bore in fluid communication with the secondary valve. A spray actuator is mounted on the top of the valve stem, overlies the upper ends of said bores, has a discharge opening, and contains a particularly efficient insert with a Venturi constriction to obtain high product to propellant ratios. The valve stem further includes transverse orifices communicating with the propellant and product bores, and first upper and second lower flexible sealing gaskets transversely aligned with and blocking the transverse orifices when the sprayer is not in use.

Upon use of the sprayer, the actuator discharge opening can occasionally clog, which can lead to a dangerous safety issue if propellant entering the actuator should, because it cannot exit the clogged discharge opening, pass down the product bore of the stem past the secondary shut-off valve, down the product conduit and into the outer thin plastic product receptacle. A sufficient pressure build-up by this means can cause the outer container to rupture and potentially injure the user. Even without such a rupture, sufficient propellant can enter the product receptacle by this means such that, after the clogged actuator discharge outlet is cleaned, the resulting product and propellant dispensed on subsequent spraying will have a considerably different product to propellant ratio then the predetermined desired ratio. This latter result, in addition to the use of excess propellant, also will effect particle size and spraying pattern of the sprayed product and thus the effectiveness of the spraying. Accordingly, a tertiary one-way valve is provided downstream of the secondary shut-off valve in the valve housing or in the conduit in the path of product flow, the said tertiary valve being adapted to close upon the aforementioned clogging to prevent any misdirected propellant entering the flexible outer product receptacle.

The inner receptacle may have the mounting cup clinched about a peripheral bead of the receptacle, which is in turn seated on a ledge of the outer receptacle adjacent its upper end and which may be retained thereon by a screw or snap cap. Pressure equalization means is also provided for the outer container as product is dispensed.

In addition, pressure filling of propellant is provided for in the present invention by pressure filling paths emanating from around the valve stem where said stem passes through the mounting cup, a first path during pressure filling extending over the top of the first upper flexible gasket and around its outer deflected edge through a plurality of passages into the inner receptacle, and a second path during pressure filling extending over the top of the first upper flexible gasket, around its inner deflected edge into the interior of the valve housing, and through side wall openings of the valve housing into the inner receptacle. The side wall openings of the valve housing are placed between the primary and secondary valves, and propellant during filling cannot pass from inside the valve housing to any part of the product flow path become of the presence of the second lower flexible gasket.

Other features and advantages of the present invention will be apparent from the following description, drawings and claims.

DESCRIPTION OF EMBODIMENT

Figure 1:
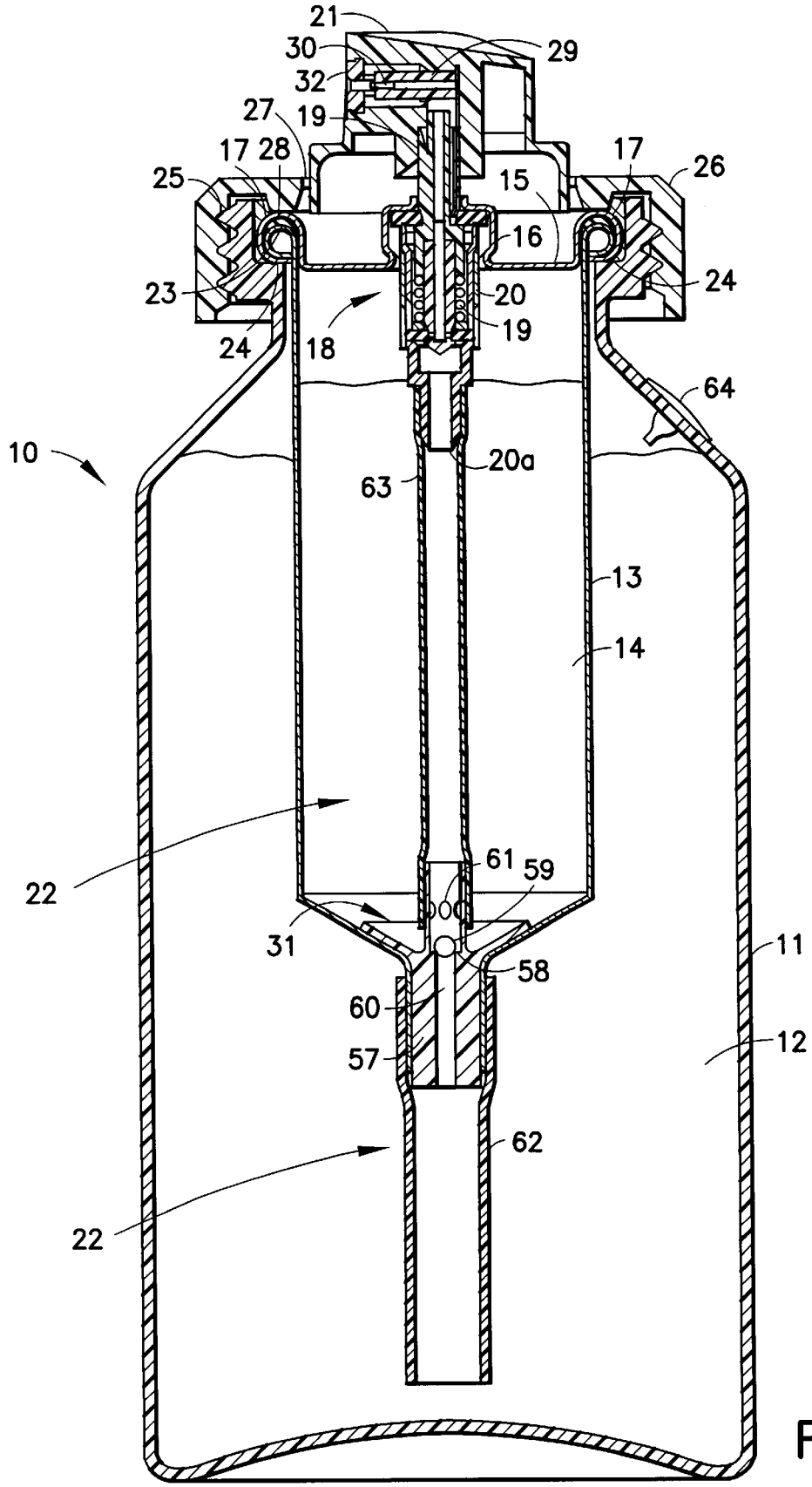
FIG. 1 is a sectional side view of the spray dispenser of the present invention in its non-operating state.
Figure 2:
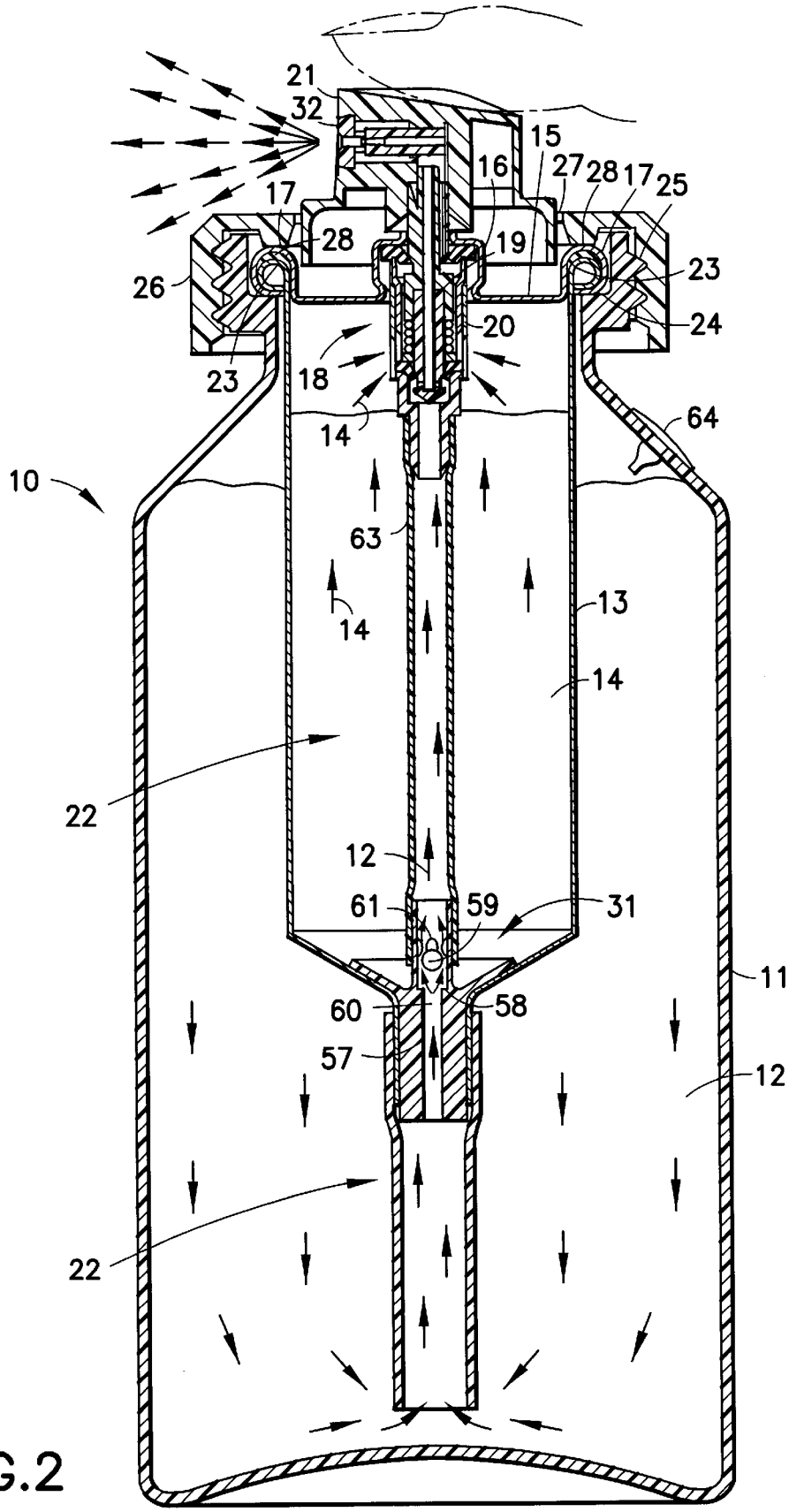
FIG. 2 is a sectional side view corresponding to FIG. 1, but with the spray dispenser of the present invention in its operating state.

FIGS. 1 and 2 illustrate generally an aerosol spray dispenser 10 having a thin, flexible plastic outer receptacle 11 for containing a product 12 to be dispensed. Receptacle 11 may be molded from a variety of plastics in a variety of shapes, sizes and colors to meet marketing needs. Various graphics also may be easily applied to the outside of plastic receptacle 11. Outer receptacle 11 will not contain a pressurized propellant, and accordingly will be thin walled for economy of manufacture since a substantial wall thickness is not required to resist propellant deformation or possible rupture. The products to be dispensed may include household products, insecticides, herbicides, cosmetic products, paints, etc.

Seated within outer receptacle 11 is inner receptacle 13 for containing a liquefied propellant 14 having a liquid phase and an overlying gaseous phase. Inner receptacle 13 will be substantially rigid to withstand deformation by the propellant, and may be made of metal or of plastic. Inner receptacle 13 is closed at its upper end by closure 15 in the form of an aerosol mounting cup as shown having a central pedestal portion 16 and a peripheral circumferential channel portion 17 as is well known in the art. Mounted within pedestal 16 of closure 15 is an aerosol valve assembly 18 hereinafter described in detail. Said valve assembly 18 includes valve stem 19 and valve housing 20, stem 19 extending upwardly through pedestal portion 16. Mounted on the top of valve stem 19 is aerosol actuator 21, the details of which are also described hereinafter. Extending downwardly from valve housing 20 within inner receptacle 13 is product conduit 22, said conduit passing through the bottom of inner receptacle 13 and into outer product receptacle 11.

Closure 15 seals inner propellant receptacle 13 by peripheral channel portion 17 being clinched about upper circumferential peripheral bead 23 of inner receptacle 13. In turn the clinched bead 23 and channel 17 rest upon circumferential ledge 24 to seat inner receptacle 13 within outer receptacle 11. The outer periphery of outer receptacle 11 is threaded at the top by threads 25. Cylindrical screw-on plastic cap 26 has a central opening 27 through which actuator 21 and valve stem 19 extend. Cap 26 further has a downwardly extending circular flange 28 which firmly captures the clinched bead 23 and channel 17 between said flange and ledge 24 when cap 26 is screwed onto outer plastic receptacle 11.

Still generally referring to FIGS. 1 and 2, FIG. 1 illustrates the spray dispenser 10 in its non-operating state. FIG. 2 on the other hand illustrates spray dispenser 10 in its operating state, the actuator 21 being operated by the user. As will be seen by the arrows, propellant 14 from inner receptacle 13 enters into aerosol valve housing 20 and is valved in a manner hereinafter described up valve stem 19 into actuator 21. Actuator 21 contains a nozzle insert 29 (discussed below) which has a Venturi constriction 30. The flow of propellant 14 out of the Venturi constriction draws product 12 from outer product receptacle 11 up product conduit 22, through tertiary valve 31 (discussed below), continuing up conduit 22 and into aerosol valve housing 20 where it is valved in a manner hereinafter described up valve stem 19 and into actuator 21. The product 12 and propellant 14 briefly mix in actuator 21, and are dispensed through the discharge outlet 32 of actuator 21.

Figure 3:
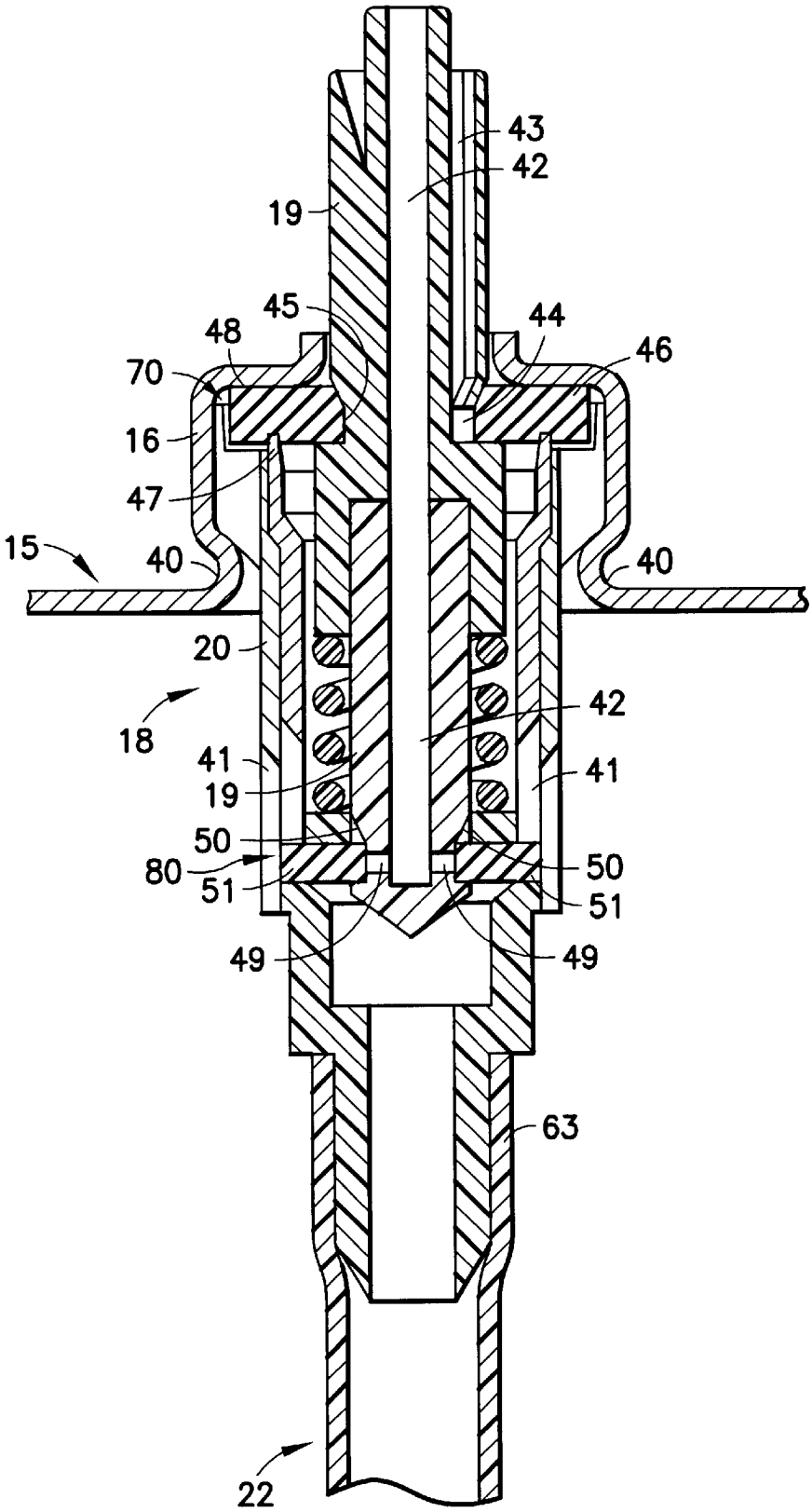
FIG. 3 is an enlarged sectional side view of the aerosol valve assembly of the present invention in its non-operating state.
Figure 4:
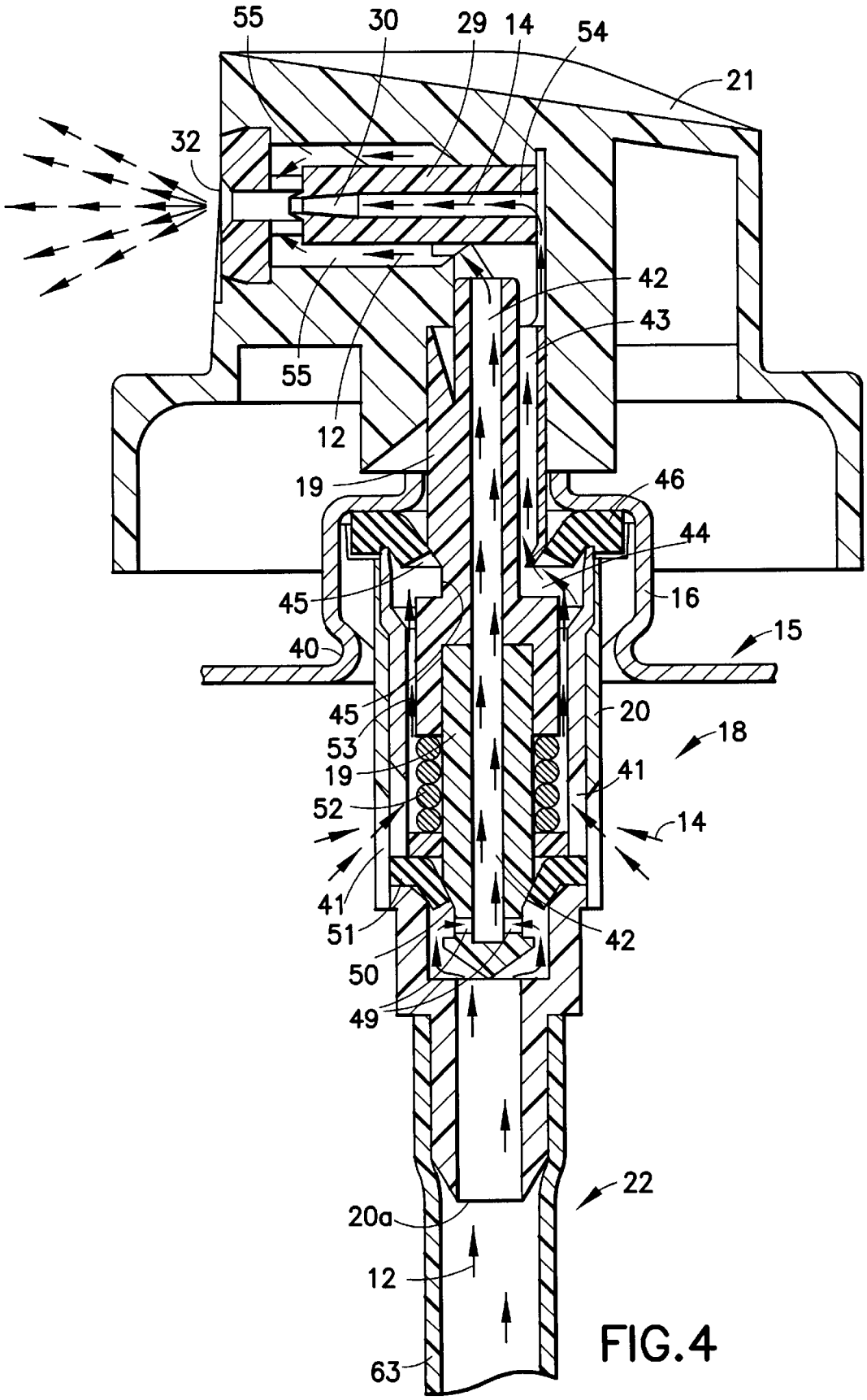
FIG. 4 is an enlarged sectional side view of the aerosol valve assembly and actuator of the present invention in its operating state.

Now referring specifically to FIGS. 3 and 4, enlarged views are shown of the aerosol valve assembly 18 (and including actuator 21 in the case of FIG. 4). FIG. 3 illustrates the valve assembly 18 in its non-operating stage and FIG. 4 illustrates valve assembly 18 in its operating state. Valve housing 20 is captured by the pedestal 16 of mounting cup closure 15 being crimped about the housing at 40. Valve housing 20 has side wall openings 41 through which propellant 14 from inner receptacle 13 enters (see FIG. 2). Product conduit 22 is connected to the lower end of valve housing 20 as shown to pass product 12 into a different portion of the valve housing 20. In the non-operating state of FIG. 3, neither product 12 nor propellant 14 can pass from the valve housing 20 into valve stem 19.

Valve stem 19 includes central product bore 42 and offset propellant bore 43, both bores being open at their upper ends. A transverse stem orifice 44 passes from propellant bore 43 through the wall of stem 19 to a circumferential groove 45 in the outer wall, said orifice being closed in FIG. 3 by circumferential flexible sealing gasket 46 extending into the groove 45 to form a primary valve 70 in the present invention. Flexible sealing gasket 46 is captured between upward circumferential protrusion 47 at the top of valve housing 20 and the top underside 48 of mounting cup pedestal 16. In a corresponding fashion, transverse stem orifices 49 pass from product bore 42 through the wall of stem 19 to a circumferential groove 50 in the outer wall, said orifices 49 being closed in FIG. 3 by circumferential sealing gasket 51 extending into groove 50 to form a secondary valve 80 in the present invention.

FIG. 4 illustrates actuator 21 fitted over the top of valve stem 19, actuator 21 containing a nozzle insert 29 with Venturi constriction 30. A particularly advantageous nozzle insert is disclosed in U.S. Pat. No. 6,036,111 issued Mar. 14, 2000 to Robert Abplanalp, which patent and its entire disclosure are incorporated herein by reference. Attention is particularly directed to FIGS. 5 through 8 and 10 of said patent, and the description relating to those figures as to the nozzle insert. Actuator 21 with nozzle insert 29 having Venturi constriction 30 establishes a high vacuum in the product channels of the actuator so as to be particularly efficient in obtaining very high product to propellant ratios in dual receptacle aerosol spray dispensers.

When actuator 21 is operated by the user pressing down thereon, valve stem 19 is depressed against spring 52 positioned between a portion of the valve stem 19 and a portion of valve housing 20. Flexible rubber sealing gaskets 46 and 51 of the primary and secondary valves respectively are pressed downwardly at their inner edges by the grooves 45 and 50 of valve stem 19. FIG. 4 shows by its arrows propellant 14 passing through the valve housing side wall openings 41 into interior valve housing space 53, into groove 45, through stem transverse orifice 44, up stem propellant bore 43, and into central channel 54 of nozzle insert 29 in actuator 21. The propellant flow through Venturi constriction 30 of nozzle insert 29 creates a high vacuum to draw product 12 from outer receptacle 11 up product conduit 22 into the lower end of valve housing 20. Said product then passes into groove 50, through stem transverse orifices 49, up central stem product bore 42, and into channels 55 surrounding nozzle insert 29 in actuator 21. The product and propellant are kept separate until they join adjacent Venturi constriction 30, and are dispensed through discharge outlet 32 of the actuator. When the actuator 21 is no longer operated by the user, the aerosol spray dispenser returns to its non-operating state of FIGS. 1 and 3.

When the aerosol spray dispenser of the present invention is in operation, discharge outlet 32 of the actuator may become clogged by the product being dispensed. When such occurs, there is a safety issue and also an efficiency of spraying issue that need to be addressed as previously described. Referring again to FIG. 4, a clogging of discharge outlet 32 during actuation still leaves propellant flowing up propellant bore 43 into the actuator 21, and since the propellant cannot exit the discharge outlet 32, it flows through product channels 55 in actuator 21 down stem product bore 42, through the open secondary valve transverse orifices 49, down product conduit 22 and toward flexible outer product receptacle 11. It is unacceptable that the propellant should reach the outer receptacle 11, since thin-walled outer receptacle 11 will deform and potentially rupture if sufficient propellant 14 is introduced therein, possibly causing injury. Further, any significant amount of propellant 14 introduced into product 12 will remain there when the user stops operation of the actuator 21 in order to declog it. Thereafter, upon subsequent operation of the actuator, the dispensed product will contain the predetermined amount of propellant from propellant bore 43, as well as the misdirected propellant previously introduced to the product receptacle 11 during the aforedescribed clogging. This of course will interfere with the predetermined spray characteristics and particle size of the product to be dispensed, resulting in a less desirable product and dissatisfied users.

Accordingly, referring back to FIG. 1 and 2, tertiary valve 31 in the form of a one-way valve is positioned in product conduit 22. Tertiary valve 31 may. take the form of any type of one-way valve, and may be positioned as shown or up in the bottom of valve housing 20, for example. In any event the tertiary valve 31 should be positioned in the product flow passage downstream of the secondary valve, and during normal operation of the spray dispenser the tertiary valve must allow product 12 to flow from inner receptacle 11 past the tertiary valve 31 up product conduit 22 into the valve housing 20. However, when the aforedescribed clogging arises, the misdirected propellant flowing down conduit 22 above tertiary valve 31 acts to immediately close tertiary valve 31 and prevent the misdirected propellant from entering outer thin-walled product receptacle 11, thereby avoiding the safety and efficiency problems described above.

As shown in FIGS. 1 and 2, tertiary valve 31 includes valve seat member 57 having valve seat 58, ball check 59 which presses against valve seat 58 during misdirected propellant flow, metering channel 60 to control normal product flow to a predetermined level, and inward protrusions 61 to define the upper limit of movement of the ball check 59 during normal product flow. Metering channel 60 is closed off by ball check 59 during misdirected propellant flow. Dip tube 62 is fitted to the lower end of valve seat member 57. Tube 63 is fitted to the lower end of valve housing 20 and to the upper end of valve seat member 57. The valve seat member 57 is sealingly fitted into the opening in the bottom of inner receptacle 13, as shown. Product conduit 22 accordingly includes dip tube 62, valve seat member 57 and tube 63 in the embodiment as shown.

As an alternative to having metering channel 60 function as the product metering orifice to control product flow and the particle size of the dispensed product, orifice 20*a* at the bottom of the valve housing (see FIGS. 1 and 4) may be sized to be of smaller diameter than that of channel 60 in order to function as the product metering orifice.

During normal operation of the aerosol spray dispenser of the present invention, it is important that the pressure above fluid product 12 in outer receptacle 11 be maintained substantially at atmospheric pressure in order to provide for proper product draw by the Venturi constriction in the actuator and to prevent inward collapsing of outer flexible receptacle 11. Accordingly, duck bill valve 64 is provided in the side wall of receptacle 11, said duct bill valve functioning to open to the atmosphere whenever the pressure in receptacle 11 is reduced by product dispensing.

Figure 5:
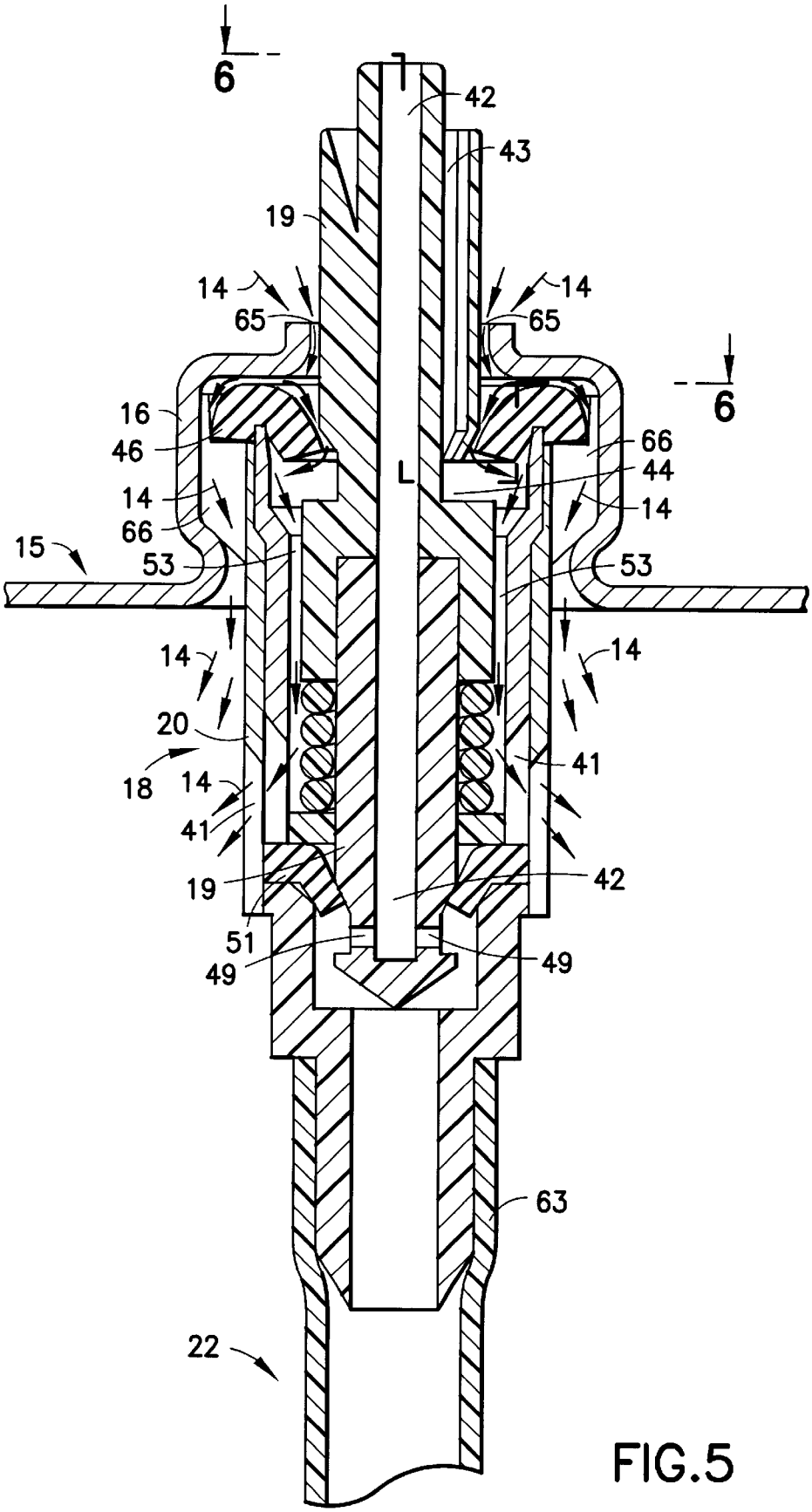
FIG. 5 is an enlarged sectional side view of the aerosol valve assembly of the present invention in its propellant pressure filling state; and, FIG. 6 is a partial cross-sectional view of the aerosol valve assembly of the present invention taken along lines 6—6 of FIG. 5.
Figure 6:
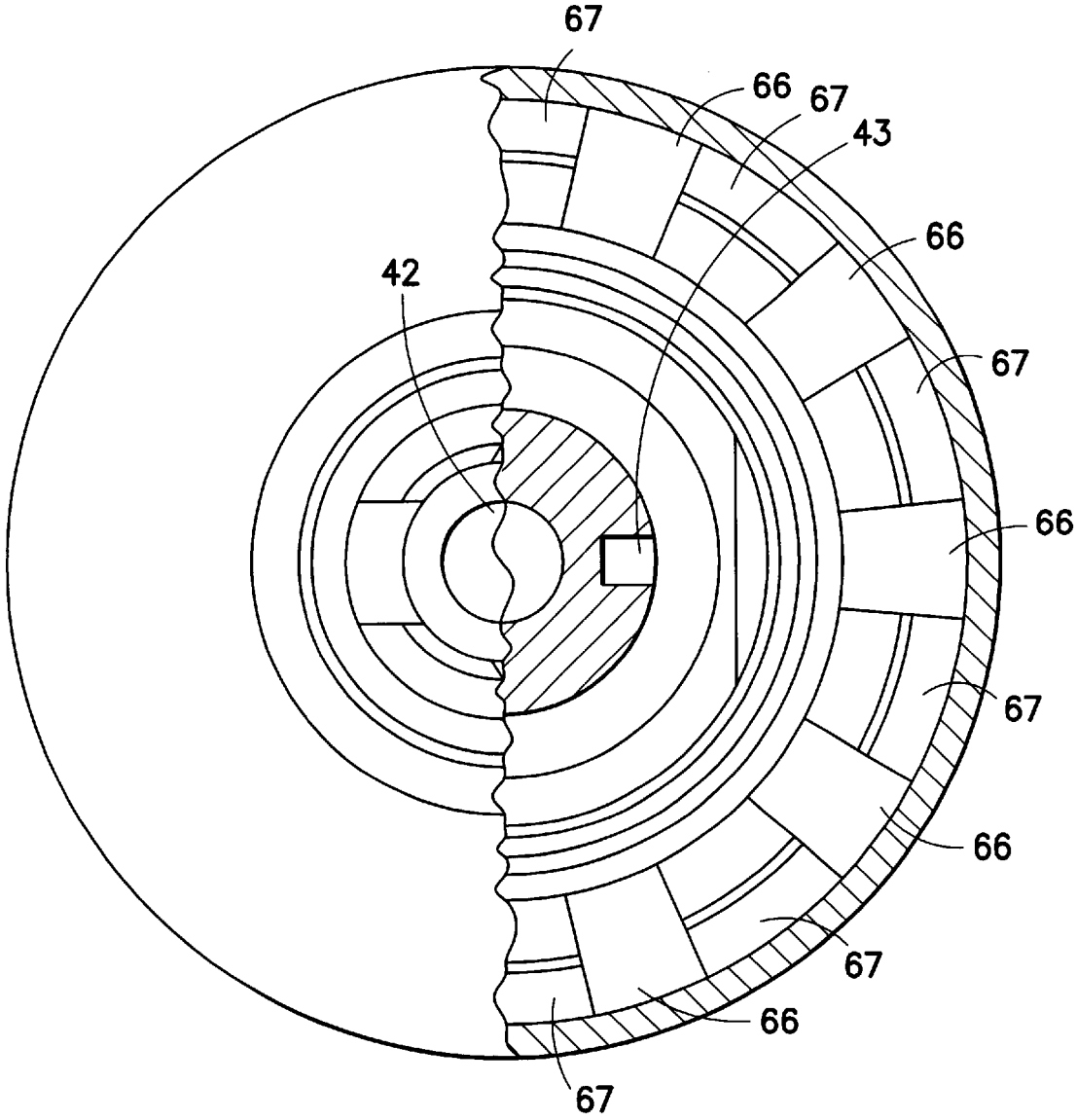

Referring now to FIGS. 5 and 6, the propellant 14 in the present invention may be pressure filled into inner receptacle 13 to achieve desired environmental and economic advantages over under-the-cup filling. In particular, the arrows show in FIG. 5 the path of propellant flow from a filling head during pressure filling. A conventional filling head (not shown) sealingly seats on mounting cup 15, depresses valve stem 19, seals off the top of bores 42 and 43, and introduces propellant into the circumferential space 65 between the periphery of the central opening of the pedestal 16 and valve stem 19. As valve stem 19 is depressed, the inner edge of flexible gasket 46 is bent over as shown. Propellant flows around the inner edge, down interior space 53 inside valve housing 20, and out through the side wall openings 41 of valve housing 20 into inner propellant receptacle 14. It will be noted that the second flexible gasket 51, though bent over by the depressed valve stem 19, still blocks any flow of propellant past gasket 51 into the lower end of valve housing 20 and down into product conduit 22. It will likewise be seen that the propellant flow upon filling depresses and passes over the top of first flexible gasket 46 and around its outer edge down into a plurality of passageways 66 provided around the periphery of the upper end of the valve housing 20 for such purpose. These passageways, separated by ribs 67, are shown on the right side of FIG. 6, it being understood that the gasket 46 is not shown in FIG. 6 in order to more clearly illustrate the propellant passageways. Said passageways are open top to bottom and exit into inner receptacle 14. Accordingly, multiple paths of propellant flow are provided for pressure filing, while preventing any of such flow from entering into the product flow path of the present invention.

In summary, the present invention provides an aerosol spray dispenser that meets the criteria set forth above in the Background of the Invention for a highly satisfactory dual receptacle sprayer having inner and outer receptacles. It will be appreciated by persons skilled in the act that variations and/or modifications may be made in the present invention without departing from the spirit and scope of the invention. The present. embodiment is, therefore, to be considered as illustrative and not restrictive.

What is claimed is:

1. An aerosol spray dispenser, comprising in combination a thin, flexible plastic outer receptacle for containing a product to be dispensed; an inner substantially rigid receptacle seated within said outer receptacle for containing a pressurized propellant out of contact with the product to be dispensed; a closure closing the top of the inner receptacle and having a valve assembly mounted thereon; said valve assembly including a valve housing, a valve stem extending outwardly of said closure, primary and secondary valves for controlling flow from said inner and outer receptacles respectively through the valve stem, and first and second resilient sealing gaskets for sealing the primary and secondary valves; a conduit forming a product flow path connected to one end of the valve assembly and extending through the inner receptacle and beyond to a length approaching the base of the product receptacle to be used with the spray dispenser, said conduit being in sealed relation with the inner receptacle at the point where it exits the inner receptacle; said valve stem defining upwardly extending product and propellant bores open at their upper ends, one of said bores being in fluid communication with the primary valve and another of said bores being in fluid communication with the secondary valve; a spray actuator for mounting on the valve stem and overlying the upper ends of said bores, said spray actuator having a discharge outlet in fluid communication with said bores; said spray actuator having a nozzle insert with a Venturi constriction whereby propellant passing from the inner receptacle and through the nozzle insert aspirates product from the outer receptacle resulting in said product and propellant exiting the spray actuator discharge outlet; a tertiary valve in the form of a one way valve positioned downstream of the secondary valve in the path of product flow, said tertiary valve opening when the spray actuator is actuated and product is drawn up the conduit from the outer receptacle; and, said tertiary valve closing upon clogging of the discharge outlet causing flow of propellant from the propellant bore into the spray actuator when actuated, down the product bore, and through the secondary valve, the tertiary valve closing under the influence of said propellant flow through the secondary valve to prevent propellant passing into the flexible outer receptacle.

2. The invention of claim 1, wherein said closure closing the top of the inner receptacle has an outer periphery, said closure being sealingly attached at or directly adjacent the outer periphery to the inner receptacle, said closure having a central portion which is attached to the valve housing.

3. The invention of claim 2, wherein the inner receptacle has a circumferential bead at the top thereof, and the closure closing the top of the inner receptacle is an aerosol valve mounting cup having an inner pedestal portion within is mounted the valve assembly, and an outer channel portion which is clinched about the circumferential bead of the inner receptacle.

4. The invention of claim 3, wherein the outer receptacle has a ledge adjacent its upper end upon which rests the channel portion of the mounting cup clinched about the circumferential bead of the inner receptacle, to seat the inner receptacle within the outer receptacle.

5. The invention of claim 4, wherein said outer receptacle is threaded at its top and further including a threaded cap member having a top wall for capturing the circumferential bead of the inner receptacle between said cap wall and the outer receptacle ledge when the cap member is screwed onto the outer receptacle.

6. The invention of claim 5 wherein said cap top wall has a central opening through which extends the valve stem and the spray actuator.

7. The invention of claim 1, wherein the flexible outer receptacle contains a duck bill valve extending through its outer wall to equalize atmospheric pressure in the outer receptacle as product is dispensed from the outer receptacle.

8. The invention of claim 1, wherein the conduit contains the tertiary valve.

9. The invention of claim 8, wherein said conduit contains a valve seat for the tertiary valve, and a ball check to act as the tertiary valve member.

10. The invention of claim 9, having a valve seat member containing said valve seat and said ball check, said conduit comprising a first tubular member having one end connected to the lower end of the aerosol valve assembly and the other end connected to the valve seat member, said valve seat member having a flow passage extending therethrough, and a second tubular member positioned in the outer receptacle and in fluid communication with said valve seat member.

11. The invention of claim 1, wherein the conduit contains a metering orifice for product flow.

12. The invention of claim 1, wherein the valve housing contains a metering orifice for product flow.

13. The invention of claim 1, wherein said valve housing includes one or more side wall openings positioned between the primary and secondary valves for communication of propellant from the inner receptacle to the interior of the valve housing.

14. The invention of claim 13, wherein propellant pressure filling paths are provided to the inner receptacle from around the valve stem at the position where said stem extends outwardly of said closure, a first path during pressure filling extending over the top of the first flexible gasket, around the outer edge of said first gasket and down into the inner receptacle, and a second path during pressure filling extending over the top of the first flexible gasket, around the inner edge of said first gasket, through the interior of the valve housing, and through said one or more side wall openings of the valve housing into the inner receptacle, further characterized by the absence of any propellant filling path extending from inside the valve housing past the second flexible gasket.

15. The invention of claim 1, wherein the secondary valve includes the second flexible sealing gasket and one or more first transverse orifices in said stem communicating with the product bore in the stem, said second flexible gasket being transversely aligned with and blocking said one or more first transverse orifices when the spray actuator is not actuated.

16. The invention of claim 15, wherein said product bore is centrally disposed in said stem.

17. The invention of claim 15, wherein the primary valve includes the first flexible sealing gasket and one or more second transverse orifices in said stem communicating with the propellant bore in the stem, said first flexible gasket being transversely aligned with and blocking said one or more second transverse orifices when the spray actuator is not actuated.

18. An aerosol spray dispenser for use with an aerosol system having an outer flexible product receptacle and an inner propellant receptacle, comprising in combination an inner substantially rigid receptacle to be seated within said outer receptacle and containing a pressurized propellant out of contact with the product to be dispensed; a closure closing the top of the inner receptacle and having a valve assembly mounted thereon; said valve assembly including a valve housing, a valve stem extending outwardly of said closure, primary and secondary valves for controlling flow from said inner and outer receptacles respectively through the valve stem, and first and second resilient sealing gaskets for sealing the primary and secondary valves; a conduit forming a product flow path connected to one end of the valve assembly and extending through the inner receptacle and beyond for extending into the outer receptacle, said conduit being in sealed relation with the inner receptacle at the point where it exits the inner receptacle; said valve stem defining upwardly extending product and propellant bores open at their upper ends, one of said bores being in fluid communication with the primary valve and another of said bores being in fluid communication with the secondary valve; a spray actuator for mounting on the valve stem and overlying the upper ends of said bores, said spray actuator having a discharge outlet in fluid communication with said bores; said spray actuator having a nozzle insert with a Venturi constriction whereby propellant passing from the inner receptacle and through the nozzle insert aspirates product from the outer receptacle resulting in said product and propellant exiting the spray actuator discharge outlet; a tertiary valve in the form of a one way valve positioned downstream of the secondary valve in the path of product flow, said tertiary valve opening when the spray actuator is actuated and product is drawn up the conduit from the outer receptacle; and, said tertiary valve closing upon clogging of the discharge outlet causing flow of propellant from the propellant bore into the spray actuator when actuated, down the product bore, and through the secondary valve, the tertiary valve closing under the influence of said propellant flow through the secondary valve to prevent propellant passing into the flexible outer receptacle.

19. An aerosol spray dispenser for use with an aerosol system having an outer flexible product receptacle, an inner propellant receptacle, an aerosol valve having product and propellant bores, and a spray actuator for mounting on the valve stem and overlying the upper ends of said bores, said spray actuator having a nozzle insert with a Venturi constriction whereby propellant passing from the inner receptacle and through the nozzle insert aspirates product from the outer receptacle resulting in said product and propellant exiting the spray actuator discharge outlet, comprising in combination a closure for closing the top of the inner receptacle and having a valve assembly mounted thereon; said valve assembly including a valve housing, a valve stem extending outwardly of said closure, primary and secondary valves for controlling flow from said inner and outer receptacles, respectively, through the valve stem, and first and second resilient sealing gaskets for sealing the primary and secondary valves; a conduit forming a product flow path connected to one end of the valve assembly for extending through the inner receptacle and beyond to a length approaching the base of the product receptacle to be used with the spray dispenser, said conduit being in sealed relation with the inner receptacle at the point where it exits the inner receptacle; said valve stem defining upwardly extending product and propellant bores open at their upper ends, one of said bores being in fluid communication with the primary valve and another of said bores being in fluid communication with the secondary valve; a tertiary valve in the form of a one way valve positioned downstream of the secondary valve in the path of product flow, said tertiary valve opening when the spray actuator is actuated and product is drawn up the conduit from the outer receptacle; and, said tertiary valve closing upon clogging of the discharge outlet causing flow of propellant from the propellant bore into the spray actuator when actuated, down the product bore, and through the secondary valve, the tertiary valve closing under the influence of said propellant flow through the secondary valve to prevent propellant passing into the flexible outer receptacle.

* * * * *